US007731312B2

(12) United States Patent
Chen et al.

(10) Patent No.: US 7,731,312 B2
(45) Date of Patent: Jun. 8, 2010

(54) RETAINING MECHANISM FOR A SLIDE ASSEMBLY

(75) Inventors: Ken-Ching Chen, Kaohsiung Hsien (TW); Shih-Long Huang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 502 days.

(21) Appl. No.: 11/730,940

(22) Filed: Apr. 5, 2007

(65) Prior Publication Data

US 2008/0246378 A1 Oct. 9, 2008

(51) Int. Cl.
*A47B 88/00* (2006.01)

(52) U.S. Cl. ..... 312/333; 312/334.46

(58) Field of Classification Search ..... 312/333, 312/334.44–334.47, 334.1, 334.7, 334.8, 312/319.1; 384/20–22
See application file for complete search history.

(56) References Cited

U.S. PATENT DOCUMENTS

| | | | | |
|---|---|---|---|---|
| 3,589,778 | A * | 6/1971 | Olson | 384/21 |
| 3,650,578 | A * | 3/1972 | Del Vecchio et al. | 384/18 |
| 4,998,828 | A * | 3/1991 | Hobbs | 384/18 |
| 6,257,683 | B1 | 7/2001 | Yang | |
| 6,350,001 | B1 | 2/2002 | Chu | |
| 6,402,275 | B1 | 6/2002 | Yang | |
| 6,450,600 | B1 * | 9/2002 | Chen et al. | 312/334.46 |
| 6,715,851 | B1 * | 4/2004 | Yang | 312/334.46 |
| 6,764,150 | B2 | 7/2004 | Le et al. | |
| 6,796,625 | B2 | 9/2004 | Lauchner et al. | |
| 6,942,307 | B1 | 9/2005 | Lammens | |
| 7,008,030 | B2 * | 3/2006 | Yang | 312/334.46 |
| 2005/0017613 | A1 * | 1/2005 | Cirocco et al. | 312/333 |
| 2006/0288529 | A1 * | 12/2006 | Chen et al. | 16/96 R |
| 2007/0040485 | A1 * | 2/2007 | Tseng et al. | 312/333 |
| 2007/0164644 | A1 * | 7/2007 | Hwang et al. | 312/333 |

FOREIGN PATENT DOCUMENTS

JP 08214965 * 8/1996

* cited by examiner

*Primary Examiner*—Janet M Wilkens
(74) *Attorney, Agent, or Firm*—Rosenberg, Klein & Lee

(57) ABSTRACT

A retaining mechanism for a slide assembly includes a first rail, a second rail, a holding member, a blocking member and a fixed plate. The second rail is slidably connected to the first rail. The holding member has a fixed end and slots. The fixed end is fixedly connected to the first rail. The blocking member has a fixed end and an engaging section, and is located between the holding member and the first rail. The fixed end of the blocking member corresponds to the fixed end of the holding member and is fixedly connected to the first rail. The engaging section corresponds to the slots of the holding member. The fixed plate is fixedly connected to the second rail and corresponds to the slots of the holding member.

5 Claims, 6 Drawing Sheets

RETAINING MECHANISM FOR A SLIDE ASSEMBLY

BACKGROUND OF THE INVENTION

1. Field of the Invention

The present invention relates to a retaining mechanism for a slide assembly, and more particularly to one having a holding member and a blocking member to prevent the slide from disengagement or retraction inward.

2. Description of the Prior Art

There are quite a few sliding rails used on drawers or cabinets to facilitate operation. Most of the prior art comprise a movable rail and a fixed rail. When the movable rail is extended outward, the movable rail will be held by the fixed rail. The movable rail can be positioned in place without being retracting backward randomly. Such position structure has two different types. One is a fixed lock, which requires a controlling device to release the movable rail, and then the movable rail can be pushed inward in relation to the fixed rail. The other is a temporally locating device, by pushing the movable rail inward to automatically release the locking position. There are a number of patents, such as U.S. Pat. Nos. 4,998,828`6,257,683 B1`6,350,001 B1`16,402,275 B1`6,764,150 B2`6,796,625 B2 and 6,942,307 B1.

These inventions all relate to an elastic type to operate the movable rail. Each of these designs has a single piece with a pair of blocking sections at respective ends to secure the movable rail in place. However, the blocking sections are formed on a one piece material. When operating the movable rail, the blocking sections may be damaged.

SUMMARY OF THE INVENTION

It is the primary object of the present invention to provide a retaining mechanism for a slide assembly, which has a holding member and a blocking member made separately, each member has its own function without disturbing each other.

It is another object of the present invention to provide a retaining mechanism for a slide assembly, which has a holding member and a blocking member made of different material for different purposes.

It is a further object of the present invention to provide a retaining mechanism for a slide assembly, which has a holding member and a blocking member made of different thickness to enhance its strength and to extend its service life.

According to the present invention, there is provided a retaining mechanism for a slide assembly comprising a first rail; a second rail slidably connected said first rail; a holding member having a fixed end and slots, said fixed end being fixedly connected to said first rail; a blocking member having a fixed end and an engaging section, said blocking member being located between said holding member and said first rail, said fixed end of said blocking member corresponding in position to said fixed end of said holding member and being fixedly connected to said first rail, said engaging section corresponding in position to said slots of said holding member; and a fixed plate being fixedly connected to said second rail and corresponding in position to said slots of said holding member, wherein said engaging section of said blocking member is formed with ribs for extending through said slots of said holding member, wherein said holding member is provided with a protuberance and said first rail is provided with a restraining piece for engagement of said protuberance, wherein said holding member is provided with a raised pressing section, wherein said fixed end of said holding member and said fixed end of said blocking member are connected together.

DETAILED DESCRIPTION OF THE PREFERRED EMBODIMENT

Figure 1:
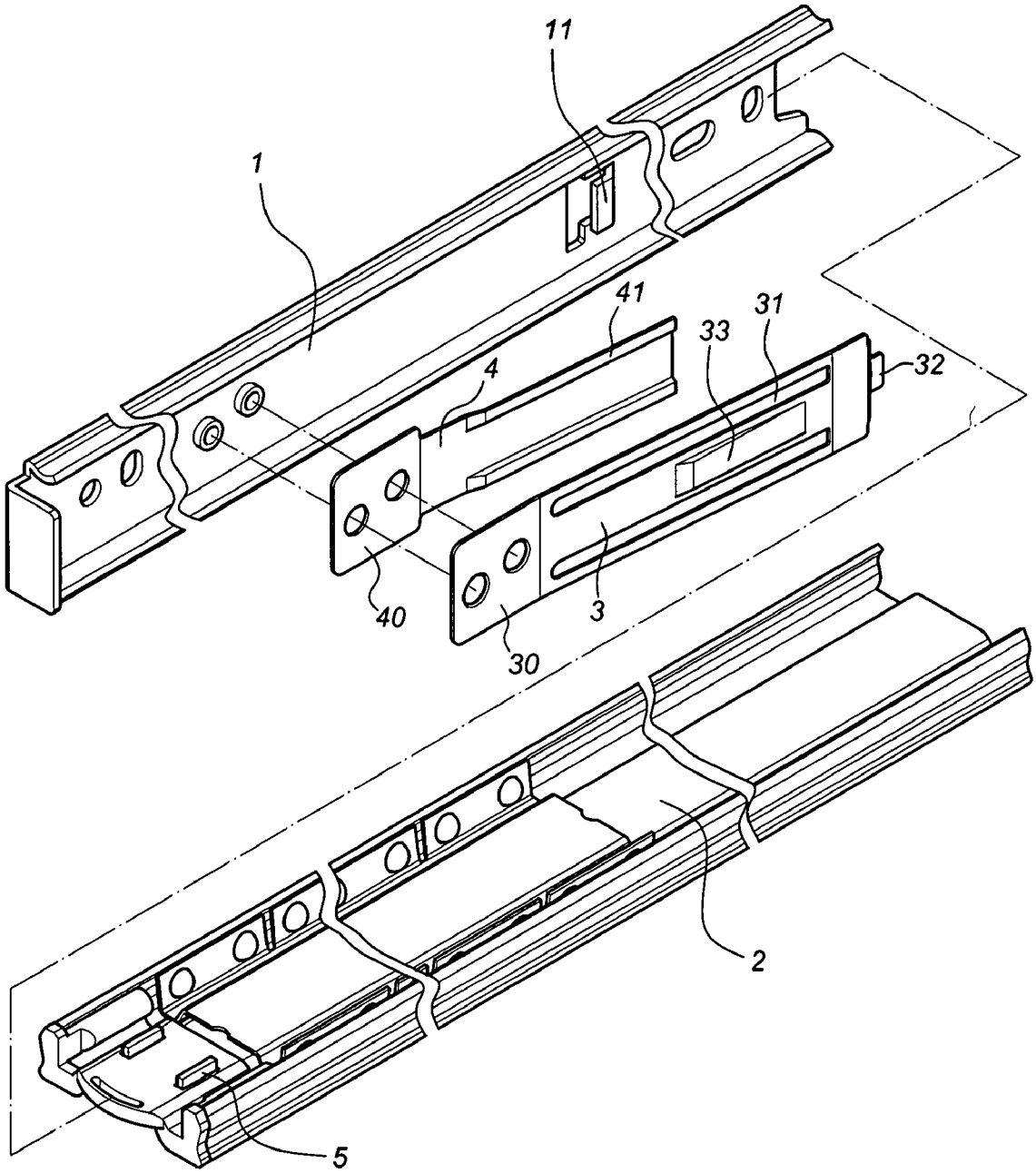
FIG. 1 is an exploded view of a first embodiment of the present invention.
Figure 2:
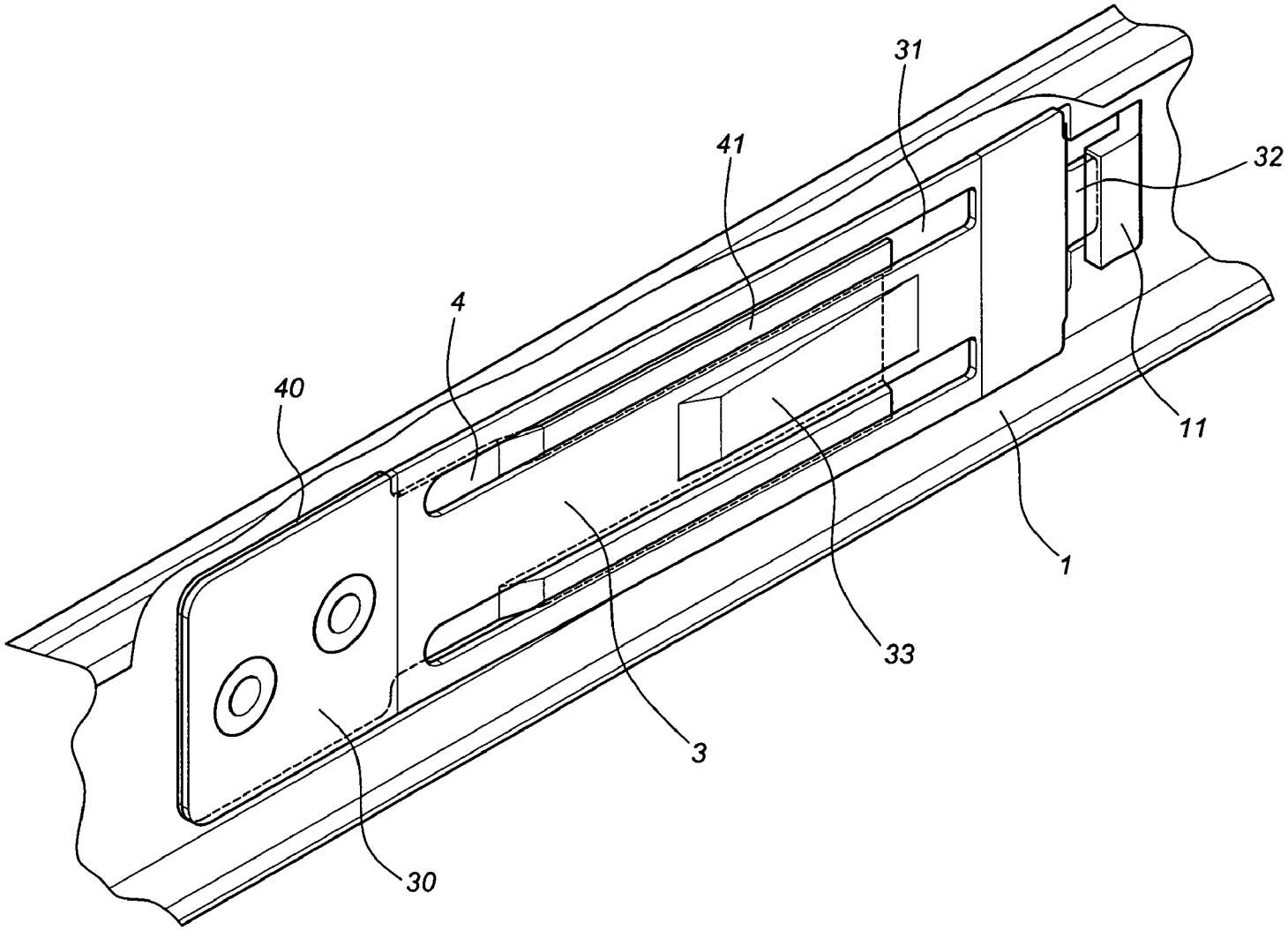
FIG. 2 is a perspective view of a first rail of the first embodiment of the present invention.

As shown in FIGS. 1 and 2, a preferred embodiment of the present invention comprises a first rail 1, a second rail 2, a holding member 3, a blocking member 4, and a fixed plate 5.

The first rail 1 comprises a restraining piece 11.

The second rail 2 is slidably connected to the first rail 1.

The holding member 3 has a fixed end 30, a pair of slots 31, a protuberance 32, and a pressing section 33. The fixed end 30 is fixedly connected to the first rail 1. The protuberance 32 corresponds in position to the restraining piece 11 of the first rail 1 and is restrained by the restraining piece 11. The pressing section 33 is a bulge for the user to press easily.

The blocking member 4 is located between the first rail 1 and the holding member 3, and comprises a fixed end 40 and an engaging section 41. The fixed end 40 corresponds in position to the fixed end 30 of the holding member 3, and is fixedly connected to the first rail 1. The engaging section 41 is formed with a pair of ribs which are inserted into the slots 31 of the holding member 3.

The fixed plate 5 is fixedly connected to one end of the second rail 2 and corresponds in position to the slots 31 of the holding member 3.

The holding member 3 and the blocking member 4 are overlapped and secured to the inner of the first rail 1. The blocking member 4 is located between the first rail 1 and the holding member 3. The engaging section 41 of the blocking member 4 corresponds to the slots 31, with the ribs of the engaging section 41 extending through the slots 31 of the holding member 3. The ribs are not absolutely necessary in this design. There is a gap kept between the rear end of the engaging section 41 and the rear ends of the slots 31. The gap is for the fixed plate 5 to be inserted therein.

The protuberance 32 of the holding member 3 engages with the restraining piece 11, which provides the holding member 3 a pressing force.

Figure 3:
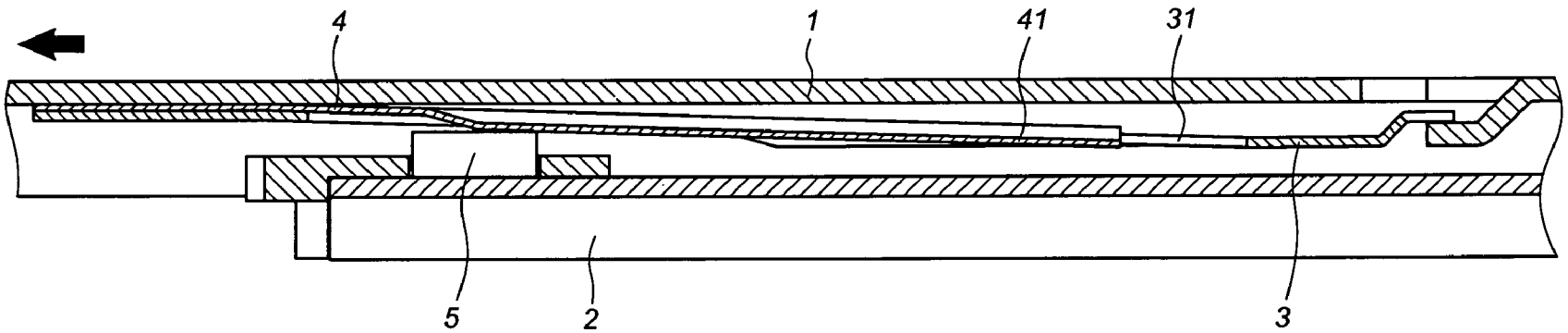
FIG. 3 is a first cross-sectional view showing that the first rail of the first embodiment of the present invention is pulled outward (a fixed plate engaging with an engaging section of a blocking member)

As shown in FIG. 3, the first rail 1 is pulled outward in relation to the second rail 2. When the blocking member 4 of the first rail 1 reaches to the fixed plate 5 of the second rail 2, the fixed plate 5 engages with the engaging section 41 of the blocking member 4.

Figure 4:
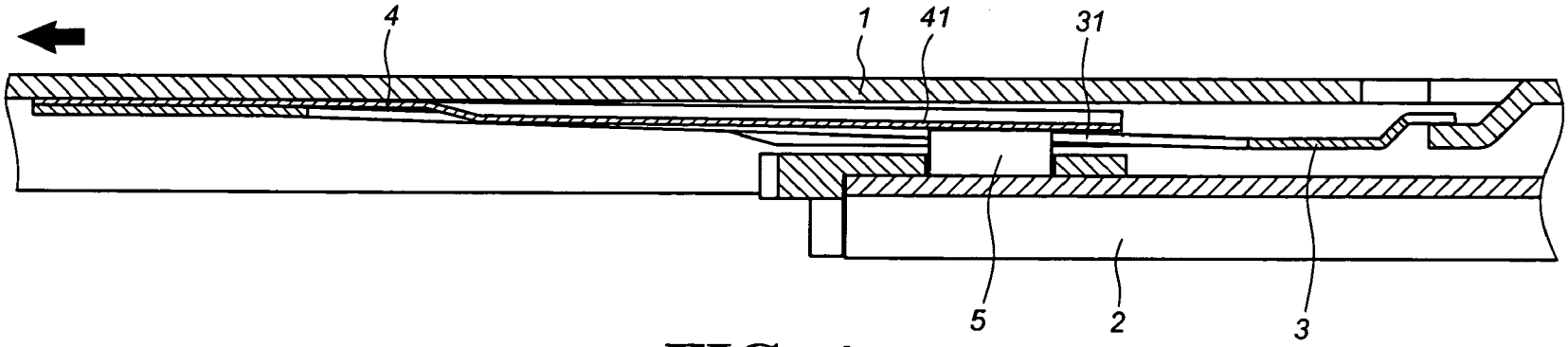
FIG. 4 is a second cross-sectional view showing that the first rail of the first embodiment of the present invention is further pulled outward (the fixed plate pressing the blocking member downward)

As shown in FIG. 4, the first rail 1 is further pulled outward in relation to the second rail 2. When the fixed plate 5 is inserted into the slots 31 of the holding member 3 and engaging with the engaging section 41, the blocking member 4 will be urged downward. The fixed plate 5 disengages from the holding member 3, which keeps the rear end of the slot 31 remains in an altitude corresponding to and engaging with the fixed plate 5.

Figure 5:
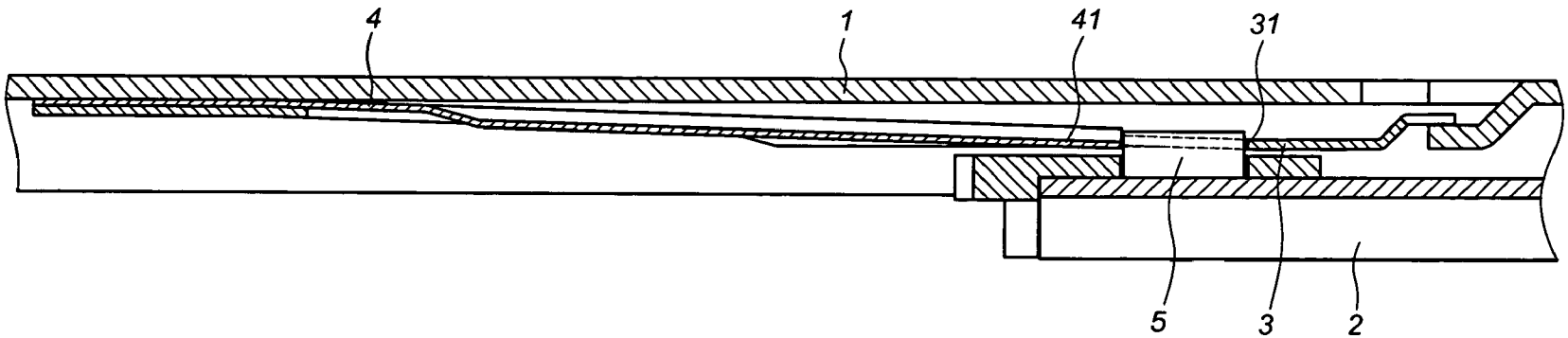
FIG. 5 is a third cross-sectional view showing that the first rail of the first embodiment of the present invention is pulled to its extremity (the fixed plate engaging with the blocking member and the holding member)

As shown in FIG. 5, when the fixed plate 5 slides past the engaging section 41, the blocking member 4 will bounce back to its original position. The fixed plate 5 is located in the gap between the rear ends of the engaging section 41 and the slots 31. The first rail 1 is restrained in its extremity of extension, without the possibility of department or retraction.

Figure 6:
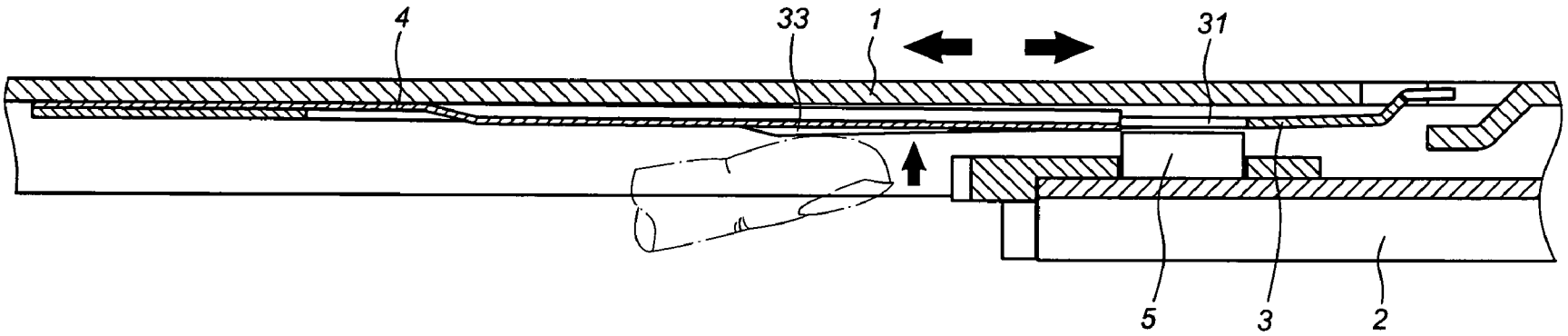
FIG. 6 is a cross-sectional view showing that the first rail of the first embodiment of the present invention is in an unlocked status.

When the pressing section 33 of the holding member 3 is pressed, as shown in FIG. 6, both the holding member 3 and the blocking member 4 will be pressed downward, which releases the engagement of the slots 31 and the fixed plate 5, the first rail 1 may either be pushed inward or pulled outward from the second rail 2.

Figure 7:
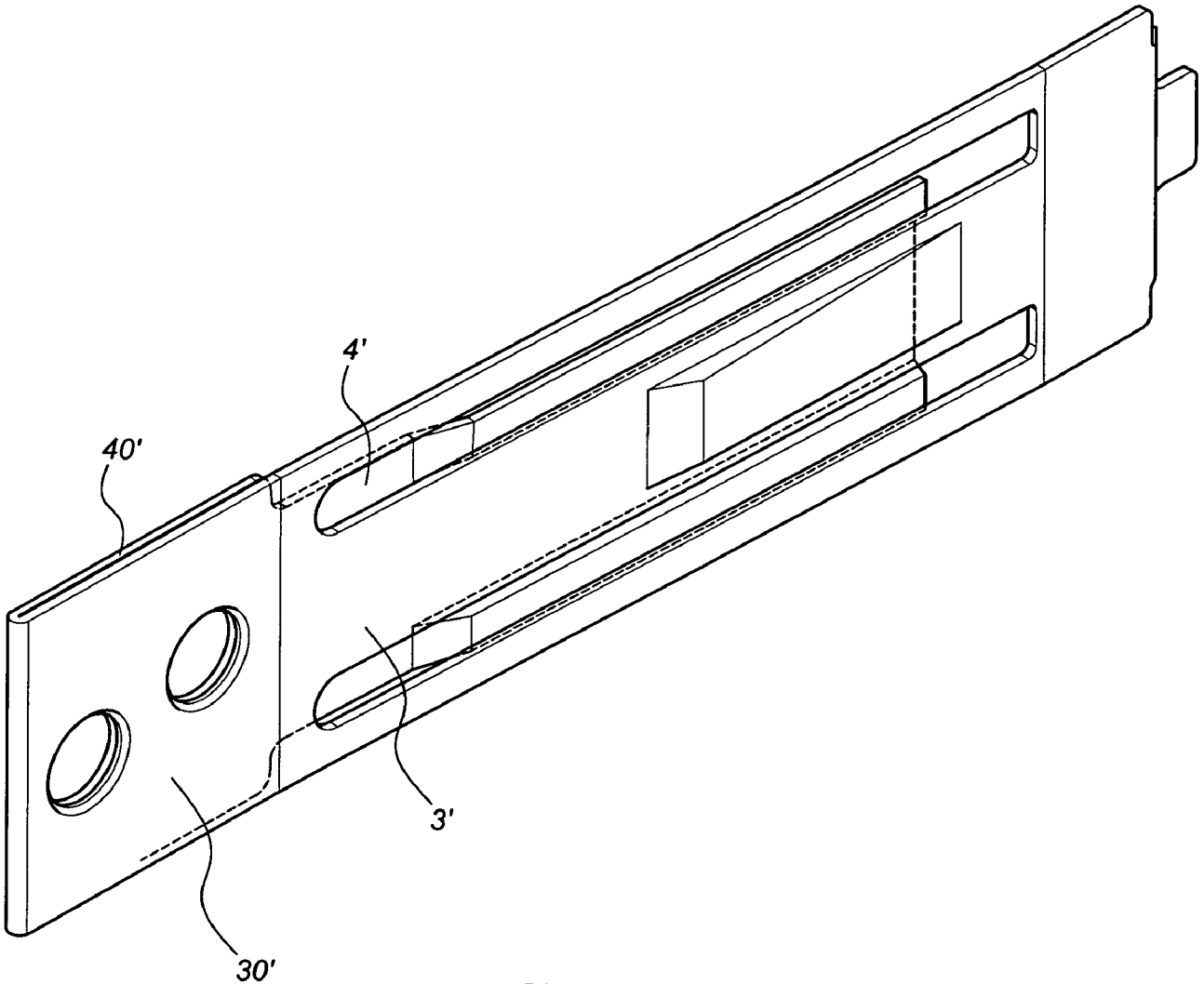
FIG. 7 is a perspective view of a second embodiment of the present invention.

FIG. 7 shows another embodiment of the present invention. A fixed end 30' of a holding member 3' and a fixed end 40' of a blocking member 4' are made in the form of an integral whole.

What is claimed is:

1. A system having a retaining mechanism for a slide assembly, comprising:

a first rail;

a second rail, said first rail being slidably connected to said second rail;

a holding member having a fixed end and slots, said fixed end being fixedly connected to said first rail;

a blocking member having a fixed end and an engaging section, said blocking member being located between said holding member and said first rail, said fixed end of said blocking member corresponding in position to said fixed end of said holding member and being fixedly connected to said first rail, said engaging section corresponding in position to said slots of said holding member; and a fixed plate being fixedly connected to said second rail for insertion into selective ones of said slots responsive to a displacement of said first rail.

2. The system having a retaining mechanism for a slide assembly, as recited in claim 1, wherein said engaging section of said blocking member is formed with ribs for extending through said slots of said holding member.

3. The system having a retaining mechanism for a slide assembly, as recited in claim 1, wherein said holding member is provided with a protuberance and said first rail is provided with a restraining piece for engagement of said protuberance.

4. The system having a retaining mechanism for a slide assembly, as recited in claim 1, wherein said holding member is provided with a raised pressing section.

5. The system having a retaining mechanism for a slide assembly, as recited in claim 1, wherein said fixed end of said holding member and said fixed end of said blocking member are connected together.

* * * * *